United States Patent [19]

Kawabata

[11] 4,242,002

[45] Dec. 30, 1980

[54] AGITATOR MEANS FOR TOWER TYPE ABRASION MILLS

[76] Inventor: Shigekatsu Kawabata, 7-3, 1-chome, Bunkyo-ku, Tokyo, Japan

[21] Appl. No.: 36,638

[22] Filed: May 7, 1979

[30] Foreign Application Priority Data

May 22, 1978 [JP] Japan ..... 53-68950[U]

[51] Int. Cl.[3] ..... B01F 7/24

[52] U.S. Cl. ..... 366/343; 241/172; 241/46.17

[58] Field of Search ..... 366/343, 319, 320, 318, 366/64, 321, 323, 324, 247; 241/172, 46.17, 197

[56] References Cited

U.S. PATENT DOCUMENTS

| | | | |
|---|---|---|---|
| 3,469,824 | 9/1969 | Futty | 366/64 |
| 3,770,214 | 11/1973 | Gabor | 241/172 |

*Primary Examiner*—Robert W. Jenkins

*Attorney, Agent, or Firm*—William A. Drucker

[57] ABSTRACT

An agitator for tower type abrasion mills has a screw blade assembly composed of an inner screw blade and a number of outer screw blade units each having a fixed size. The outer blade units are positioned side by side along the peripheral portions of the inner blade and are fixed thereto. This realizes a long life of the agitator, low repair costs, and a remarkably short work stoppage period for the repair.

6 Claims, 7 Drawing Figures

AGITATOR MEANS FOR TOWER TYPE ABRASION MILLS

BACKGROUND OF THE INVENTION

This invention relates to agitator means for tower type abrasion mills, the agitator means having an agitating blade of a continuous screw shape.

FIG. 1 shows an example of a conventional tower type abrasion mill which is operated in a wet system. Upon pieces of ore being fed at A into cylindrical tower 8, water being supplied continuously into the tower, and milling operation being started by rotation of agitating blade 20 of a screw shape by means of motor 5, the ore within tower 8 is drawn up by agitating blade 20 and an up-and-down motion of the ore is repeated. Then, the ore, during the repeated up-and-down motion, is abraded mainly by mutual friction between the pieces of ore to produce fine particles. The particles thus produced are transported through pipe 6 by means of overflowing water to an elutriation tank not shown in the drawings, and are gathered as the product. On the other hand, water drawn from the bottom of said elutriation tank is fed back through pipe 7 into tower 8.

Agitation blade 20 which has been worn out by repeated operations must be repaired or exchanged so that further proper operations of the mill can be continued. Works for repairing an agitation blade of a shape of a screw is a considerable heavy task containing repeated cutting and welding of steel plates so as to provide again for such portions which have been worn out of the blade the blade shape exactly similar to the original one. Moreover, in most cases in which the blade had a lining of hard rubber or the like material, the blade must be lined anew after the welding work has been finished. Accordingly, loss caused by such a repair is very large due to large costs of the repair work and a long term of work stoppage. And, such a circumstances with respect to a tower type abrasion mill operated in wet system as stated above can also be applied to such a mill operated in dry system.

OBJECTS OF THE INVENTION

It is an object of this invention to provide means for extending life of agitation blades for tower type abrasion mills so that the mills may not require frequent work stoppages for the repair.

It is another object of this invention to provide means for simplifying the work for repairing a worn-out agitation blade.

It is still another object of this invention to provide means for minimizing cost for the repair for the foregoing agitating blade upon the same having been worn out.

It is still another and an important object of this invention to provide means for minimizing the period for the work stoppage which is required for the repair of the foregoing agitating blade upon the same having been worn out.

It is a further object of this invention to provide effective means for improving economy of the abrasion mills.

Further objects and merits of this invention will become apparent from the following description taken in connection with the accompanying drawings.

SUMMARY OF THE INVENTION

To achieve the foregoing objects of this invention, an agitator for tower abrasion mills according to this invention has an inner blade and a number of outer blade units. The inner blade is formed, by means of welding along a center shaft, in a shape of a screw having a relatively small diameter. Each of the outer blade units is a segment of a screw ribbon having a relatively large diameter and a screw pitch equal to the same of the inner blade. Each said outer blade unit has a thick outer edge portion and a thin inner edge portion and is, in a top plan view, a ribbon of a sector of a fixed radius and a fixed center angle. The outer blade units are positioned side by side along the periphery of the inner blade and are fixed removably with the inner edge portions of the outer blade units to the outer edge portions of the inner blade so as to form a continuous screw blade assembly.

DESCRIPTION OF THE PREFERRED EMBODIMENTS

Figure 1:
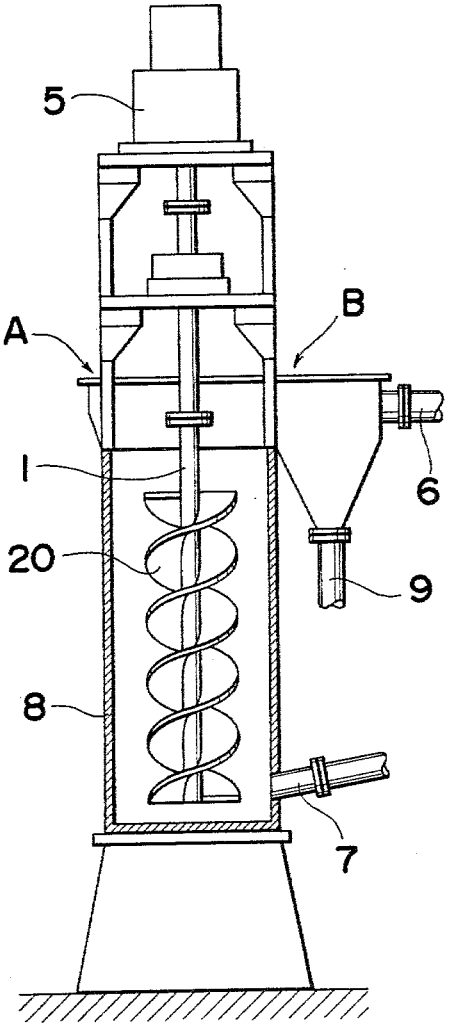
FIG. 1 is a front elevational view partly in section of a known tower type abrasion mill.
Figure 2:
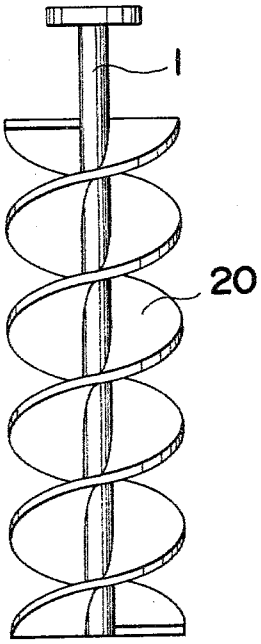
FIG. 2 (PRIOR ART)
FIG. 2 is a front elevational view of an agitator of prior art.
Figure 3:
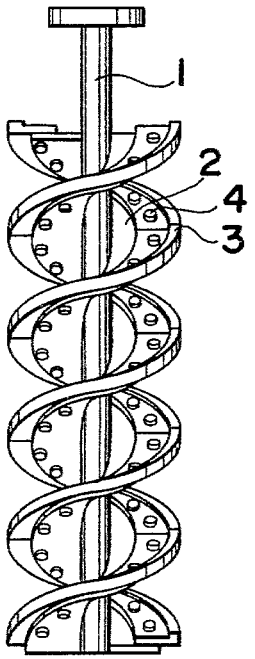
FIG. 3 is a front elevational view of an agitator according to this invention.
Figure 4:
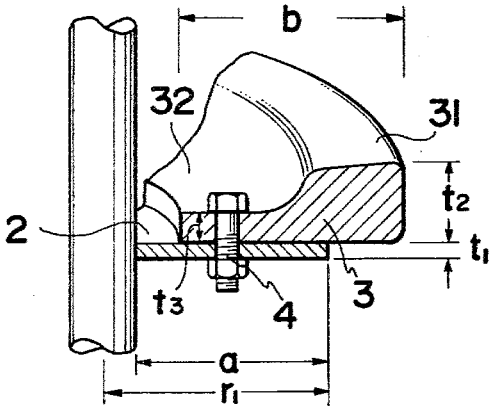
FIG. 4 is an enlarged front elevational view partly broken showing a vertical section of the agitating blade.
Figure 5:
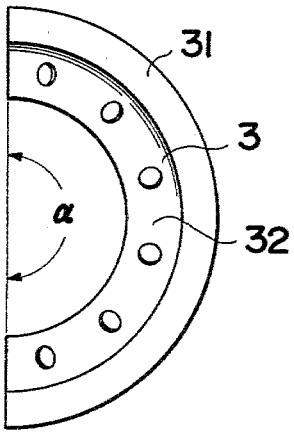
FIG. 5 is a top plan view of an outer blade unit.
Figure 6:
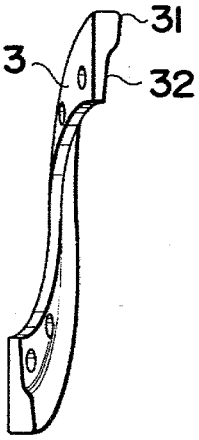
FIG. 6 is a left side elevational view corresponding to FIG. 5 of the outer blade unit, and, FIG. 7 is a front elevational view corresponding to FIG. 4 showing a vertical section of the agitating blade to illustrate advance of wear in the outer blade unit.
Figure 7:
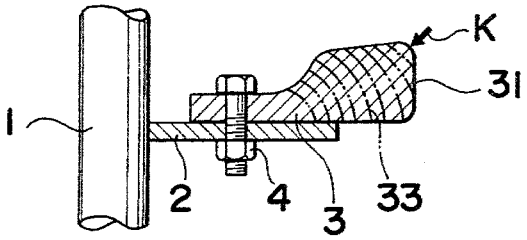

Referring now to FIGS. 3 to 7 which show an agitation blade according to this invention, numeral 2 is an inner blade formed in a shape of a continuous screw. Inner blade 2 is formed along and welded to center shaft 1 having a diameter of 130 mm. In FIG. 4, width $a=120$ mm, radius $r_1=185$ mm as measured from the center of shaft 1, thickness $t_1=9$ mm. In the drawings, width a and radius $r_1$ are drawn for convenience respectively enlarged beyond natural sizes. Numeral 3 indicates an outer blade unit. Width $b=220$ mm, thickness of the outer edge portion $t_2=60$ mm, and thickness of the inner edge portion $t_3=30$ mm. As seen particularly from FIGS. 5 and 6, outer blade unit 3 is a segment of a screw ribbon having a center angle $\alpha$ of 180 degrees. The screw ribbon is formed as having a pitch which is equal to that of inner blade 2. And, as seen particularly from FIG. 3, outer blade units 3 are positioned side by side along the peripheral portions of inner blade 2 and are fixed to center blade 2 by means of bolts and nuts so that a continuous screw blade assembly is formed by an inner blade and a number of outer blade units. For feasibility of manufacture, center angle $\alpha$ may be 120 degrees or 90 degrees according to the size of the blade assembly. The size of a blade assembly herein means the width of the blade assembly as measured from the cylindrical face of the center shaft to the outer edges of the outer blade units. And, in cases in which the said size is relatively large, the inner blade and each outer blade unit are peferably lined with a lining material prior to assembly of the blades.

According to this invention, an agitator takes a form, such as shown in FIG. 3, of a continuous screw which has a thin central portion fixed to the center shaft and thick outer edge portions.

Now, in a tower type abrasion mill, pieces of ore which have been charged in the tower are drawn up by means of rotation of the agitator. And, referring to FIG. 7, the force exerted by said pieces of ore on the blade is a combined force K of downward and centripetal forces, and the direction of advance of wear of the blade is proportional to force K. So, wear of the blade advances in a manner such as indicated at chain lines 33 which show worn faces from time to time of the outer blade unit 3.

According to this invention, as the outer edge portions of the outer blade units are formed thick, combined force K which is the main abrasion force caused by operation of the mill is received at all times by quite wide faces such as seen from chain lines 33. Accordingly, life of an agitator until the blade assembly is made to be of no use is extended remarkably. And, as stated above, as substantially only the outer blade units, each of which is of a size and shape equal to each other and is fixed removably to an inner blade which receives essentially little abrasion force are subjected to wear, such worn out outer blade units can be removed easily from the inner blade so as to be exchanged within a short time.

In consequence, according to this invention, not only the life of agitator means in tower type abrasion mills can be extended largely, low repair costs and a quite short stoppage period for the repair so as to achieve a notable improvement in the economy of abrasion mills can be realized.

What I claim is:

1. Agitator means, for tower type abrasion mills, comprising a continuous helical blade assembly, said helical blade assembly being composed of:

(i) a center shaft, (ii) an inner helical blade of fixed pitch secured on the periphery of said center shaft (iii) a segmental outer helical blade of the same pitch as said inner helical blade, said outer helical blade being composed of a plurality of outer blade segments placed end to end, said outer blade segments being secured removably on said inner helical blade, said segmental outer helical blade having an inner circumferential periphery spaced radially from and coaxial with said center shaft, said segmental outer helical blade having its external diameter greater than the external diameter of said inner helical blade, said segmental outer helical blade having its external circumferential periphery coaxial with said center shaft, each of said outer blade segments including a radially inner portion and a radially outer portion, said radially outer portion being relatively axially thicker than said radially inner portion, each of said outer blade segments having the same angular extent.

2. Agitator means, for tower type abrasion mills, as claimed in claim 1, wherein said angular extent does not exceed 180 degrees.

3. Agitator means, for tower type abrasion mills, as claimed in claim 2, wherein said angular extent is 180 degrees.

4. Agitator means, for tower type abrasion mills, as claimed in claim 2, wherein said angular extent is 120 degrees.

5. Agitator means, for tower type abrasion mills, as claimed in claim 2, wherein said angular extent is 90 degrees.

6. Agitator means, for tower type abrasion mills, as claimed in claim 1, wherein said outer blade segments are secured to said inner helical blade by bolts and nuts.

* * * * *